US012653267B2

(12) United States Patent
Diard et al.

(10) Patent No.: US 12,653,267 B2
(45) **Date of Patent: *Jun. 16, 2026**

(54) SOLE INCLUDING MULTIPLE SUPPORT MEMBERS

(71) Applicant: DECKERS OUTDOOR CORPORATION, Goleta, CA (US)

(72) Inventors: Jean-Luc Diard, Annecy (FR); Stephen Liu, PanYu District GuangZhou City (CN); Christophe Aubonnet, Tresserve (FR); Stephen Kass, Carpinteria, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/805,488

(22) Filed: Aug. 14, 2024

(65) Prior Publication Data

US 2024/0398062 A1 Dec. 5, 2024

Related U.S. Application Data

(63) Continuation of application No. 17/479,979, filed on Sep. 20, 2021, now Pat. No. 12,082,642.

(51) Int. Cl.
*A43B 13/12* (2006.01)
*A43B 13/22* (2006.01)

(52) U.S. Cl.
CPC ..... *A43B 13/125* (2013.01); *A43B 13/226* (2013.01)

(58) Field of Classification Search
CPC ... A43B 3/0068; A43B 3/0073; A43B 7/1405; A43B 13/026; A43B 13/125; A43B 13/14; A43B 13/141; A43B 13/145; A43B 13/16; A43B 13/226; A43B 13/37; A43B 13/41; A43B 21/24; A43B 23/08; A43B 23/081; A43B 23/087; A43B 23/088
USPC ..... 36/28, 29, 76 R
See application file for complete search history.

(56) References Cited

U.S. PATENT DOCUMENTS

| | | | |
|---|---|---|---|
| 5,784,808 | A | 7/1998 | Hockerson |
| 6,954,998 | B1 | 10/2005 | Lussier |
| 8,984,775 | B2 | 3/2015 | Dombrow et al. |
| 9,462,845 | B2 | 10/2016 | Auger et al. |
| 9,629,413 | B2 | 4/2017 | Stien |
| 9,968,160 | B2 | 5/2018 | Peyton |
| 10,448,704 | B2 | 10/2019 | Dupre et al. |
| 10,945,489 | B2 | 3/2021 | Conrad et al. |

(Continued)

FOREIGN PATENT DOCUMENTS

| | | | |
|---|---|---|---|
| CN | 115836766 | A | 3/2023 |
| EP | 1844673 | A1 | 10/2007 |

(Continued)

*Primary Examiner* — Matthew R Marchewka
(74) *Attorney, Agent, or Firm* — Greer, Burns & Crain, Ltd

(57) ABSTRACT

An article of footwear is provided and includes a sole including a longitudinal axis and a lateral support member, a medial support member and a front support member that are independent from each other and combine to form a triangular contact region on a bottom surface of the sole, where the lateral support member has a front end and a rear end the medial support member has a front end and a rear end, and the lateral support member and the medial support member are entirely spaced apart from each other across the longitudinal axis of the sole.

18 Claims, 4 Drawing Sheets

(56) References Cited

U.S. PATENT DOCUMENTS

| | | | | |
|---|---|---|---|---|
| 11,000,093 | B2 | 5/2021 | Connell et al. | |
| 2003/0093920 | A1 | 5/2003 | Greene et al. | |
| 2007/0240331 | A1 | 10/2007 | Borel | |
| 2014/0059883 | A1* | 3/2014 | Adeagbo | A43B 13/184 36/28 |
| 2015/0327624 | A1* | 11/2015 | Grott | A43B 13/184 36/91 |
| 2016/0353834 | A1 | 12/2016 | Luedecke et al. | |
| 2017/0143074 | A1 | 5/2017 | Southern et al. | |
| 2018/0213886 | A1 | 8/2018 | Connell et al. | |
| 2020/0113272 | A1 | 4/2020 | Aubonnet et al. | |
| 2020/0178644 | A1 | 6/2020 | Hillyer et al. | |
| 2020/0383421 | A1 | 12/2020 | Bidal et al. | |
| 2021/0259351 | A1 | 8/2021 | Aubonnet et al. | |
| 2023/0089617 | A1 | 3/2023 | Diard et al. | |

FOREIGN PATENT DOCUMENTS

| | | | |
|---|---|---|---|
| EP | 3750437 | A1 | 12/2020 |
| EP | 4151113 | A1 | 3/2023 |
| WO | 2016196770 | A1 | 12/2016 |

* cited by examiner

SOLE INCLUDING MULTIPLE SUPPORT MEMBERS

CROSS REFERENCE TO RELATED APPLICATIONS

This application is a continuation application of and claims priority to U.S. patent application Ser. No. 17/479,979 filed on Sep. 20, 2021, which is incorporated herein by reference.

BACKGROUND

The present application relates generally to footwear, and more particularly, to a sole including multiple support members for footwear that support a user's feet while providing balance and stability on uneven terrain.

Running involves the transfer of energy between a person's legs and feet and an underlying surface, such as the ground, contributing to propel a person forward along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. In particular, the propulsion generated by a person's legs and feet is important while jogging or running. If a person's feet are not sufficiently supported by their shoes and their feet to do not have a stable push off point, less energy could be transferred from the person's feet to the ground to propel the person forward.

Running outdoors, and more specifically, running on trails involves inclines, declines and different terrains and weather conditions. Due to these factors, it is important for a runner to maintain stability, balance and control while running. It is also important for a runner's feet to be sufficiently supported and cushioned as they encounter different terrains, such as pavement in urban environments and gravel and rocks on trails and in more rural environments. In this regard, an important aspect of stability and balance while walking or running uphill or downhill occurs in the heel area of a person's foot. As the heel area of a shoe contacts uneven terrain when a person is going uphill or downhill, the heel will become imbalanced and twist and may cause the person to injure themselves or fall.

It is therefore desirable to provide footwear that supports and cushions a person's feet during walking, jogging and running that enables a person to remain stable and balanced while moving along all types of terrain.

SUMMARY

The present article of footwear has a sole with a lateral support member, a medial support member and a front support member that form three contact areas of the sole on an underlying surface to provide balance and support to a user during movement.

In an embodiment, an article of footwear is provided and includes a sole including a longitudinal axis and a lateral support member, a medial support member and a front support member that are independent from each other and combine to form a triangular contact region on a bottom surface of the sole, where the lateral support member has a front end and a rear end the medial support member has a front end and a rear end, and the lateral support member and the medial support member are entirely spaced apart from each other across the longitudinal axis of the sole.

In another embodiment, a sole for an article of footwear is provided and includes a midsole including a longitudinal axis and a lateral support member, a medial support member and a front support member that are independent from each other and combine to form a triangular contact region including the lateral support member, where the medial support member and the front support member are on a bottom surface of the midsole, and the lateral support member and the medial support member are entirely spaced apart from each other across the longitudinal axis of the midsole. The rear end of the midsole having an indentation between said lateral support member and said medial support member and an outsole is attached to at least one of the lateral support member, the medial support member and the front support member.

DETAILED DESCRIPTION

The present invention is directed to an article of footwear or shoe having a sole with support members that form multiple, spaced contact or pressure points with an underlying surface to enhance the balance and stability of the shoe on different surfaces and terrain, such as pavement or uneven trail surfaces. More specifically, the enhanced balance and stability provided by the present shoe enables a person to maintain their balance and stride during walking, jogging and running while also providing support and cushioning to the person's feet.

Figure 1:
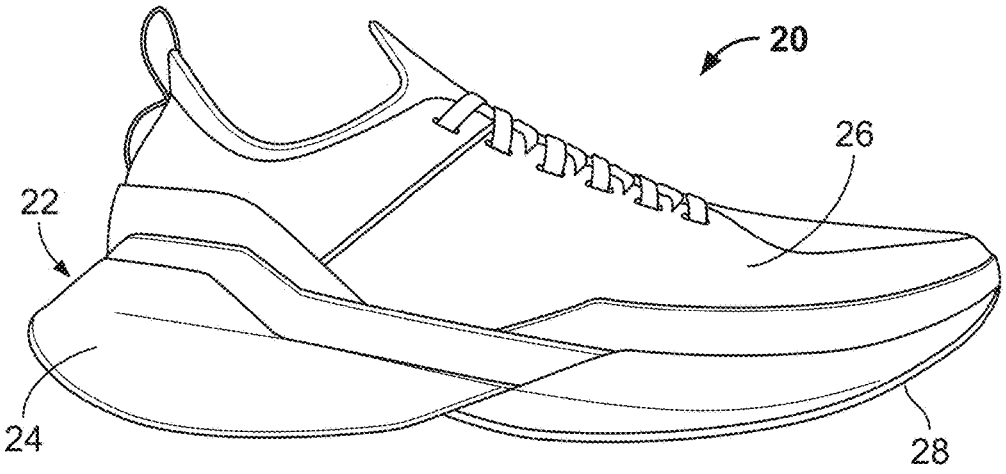
FIG. 1 is a side view of an embodiment of footwear including the present sole including multiple support members.
Figure 2:
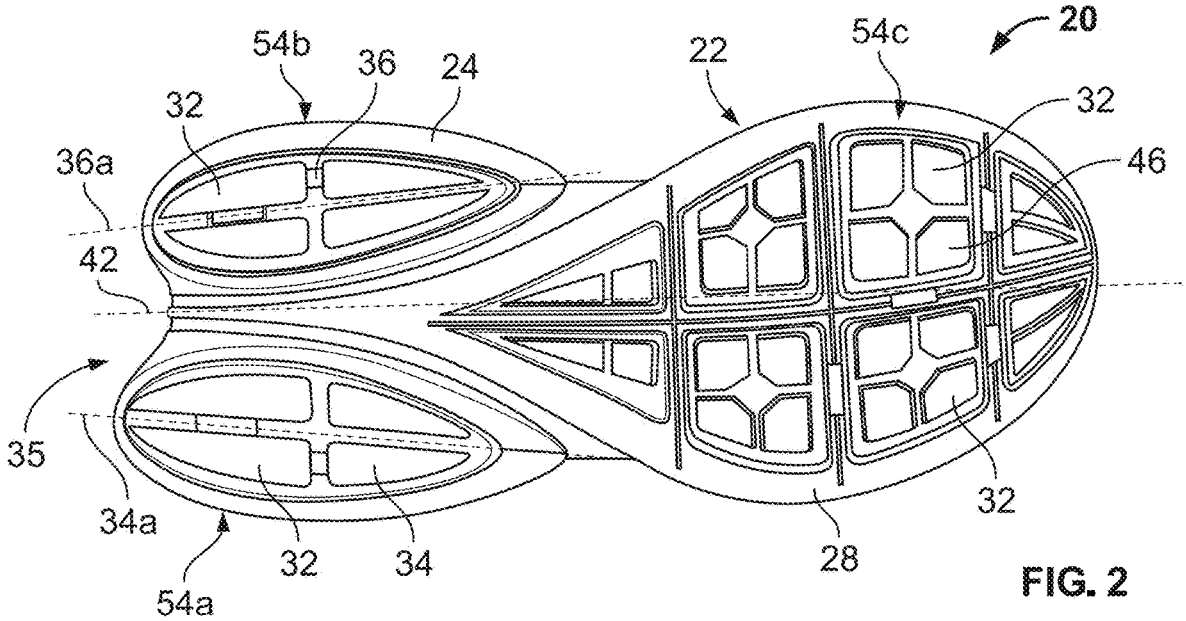
FIG. 2 is a bottom view of the footwear of FIG. 1.
Figure 3:
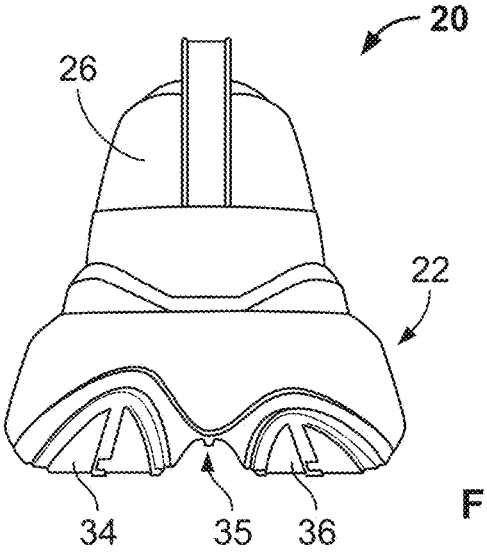
FIG. 3 is a rear view of the footwear of FIG. 1.

Referring now to FIGS. 1-3, an article of footwear or shoe 20 includes an embodiment of the present sole, generally indicated as 22, where the sole 22 includes a midsole 24 attached to an upper 26, and an outsole 28. The midsole 24 may be an integral, molded component made of a material having a designated hardness value or made with different materials having the same or different hardness values. For example, one or more portions of the midsole 24 may be made with a material having a hardness or hardness value that is greater than a hardness or hardness value in other areas of the midsole to increase the stability and support or cushioning in designated areas of the midsole. As shown in FIG. 1, the outsole 28 is attached to a bottom surface 30 of the midsole 24 by an adhesive or by molding, and is made of rubber. The outsole 28 typically includes a plurality of tread members 32 that are configured to grip an underlying surface, such as the ground, during movement. It should be appreciated that the midsole 24 and outsole 28 may be made of any suitable materials or combinations of materials.

As shown in FIGS. 2 and 3, the sole 22 includes a lateral support member 34 and a medial support member 36 that are spaced apart from each other by a channel 35 formed at least partially in the heel area 38 of the sole 22 where the channel 35, the lateral support member and the medial support member each extend at least partially into the midfoot area 40 of the sole. In the illustrated embodiment, the lateral support member 34 and the medial support member 36 are each independent support members or pods separated by the channel 35. Further, the lateral and medial support members 34 and 36 each have an oblong, tear-drop shape and are angled outwardly from the heel area 38 toward the midfoot area 40 of the sole. It should be appreciated that the lateral and medial support members 34 and 36 may be any suitable shape and size. In an embodiment, the lateral and medial support members 34 and 36 each have a longitudinal axis 34*a* and 36*a* forming an angle of fifteen (15) degrees relative to the longitudinal axis 42 of the sole as shown in FIG. 2. The lateral and medial support members 34 and 36 may form any suitable angle with the longitudinal axis 42 and may extend away from or toward the longitudinal axis 42 from the heel area 38 toward the midfoot area 40 of the sole 22. It is also contemplated that the longitudinal axes 34*a* and 36*a* of the lateral and medial support members 34 and 36 may be parallel to the longitudinal axis 42 of the sole 22.

In the illustrated embodiment, the lateral and medial support members 34 and 36 are each formed in the midsole 24 by molding or another suitable method where the lateral and medial support members extend from, i.e., extend below, the bottom surface 30 of the midsole 24. The thickness of each support member 34 and 36 is preferably 30 mm, but may be any suitable thickness. Furthermore, the thickness of the portions of the midsole 24 forming the lateral and medial support members 34 and 36 may be the same thickness or different thicknesses. For example, the lateral support member 34 may have a thickness that is greater than a thickness of the medial support member 36 such that the lateral support member extends a greater distance from the bottom surface 30 of the midsole 24 than the medial support member. Alternatively, the medial support member 36 may have a thickness that is greater than a thickness of the lateral support member 34 such that the lateral support member extends a greater distance from the bottom surface 30 of the midsole 24 than the medial support member. Forming the lateral and medial support members 34 and 36 with different thicknesses may be used to overcome pronation or supination of a user's feet during walking or running or to account for uneven terrain. As shown in FIGS. 2 and 3, a portion of the outsole 28 is attached to the bottom surfaces of the lateral and medial support members 34 and 36 to enable the support members to grip an underlying surface. The portions of the outsole 28 are preferably made of rubber, but may be made with any suitable material or combination of materials. Each outsole portion also includes one or more tread members 32 that may be the same shape or different shapes.

Figure 4:
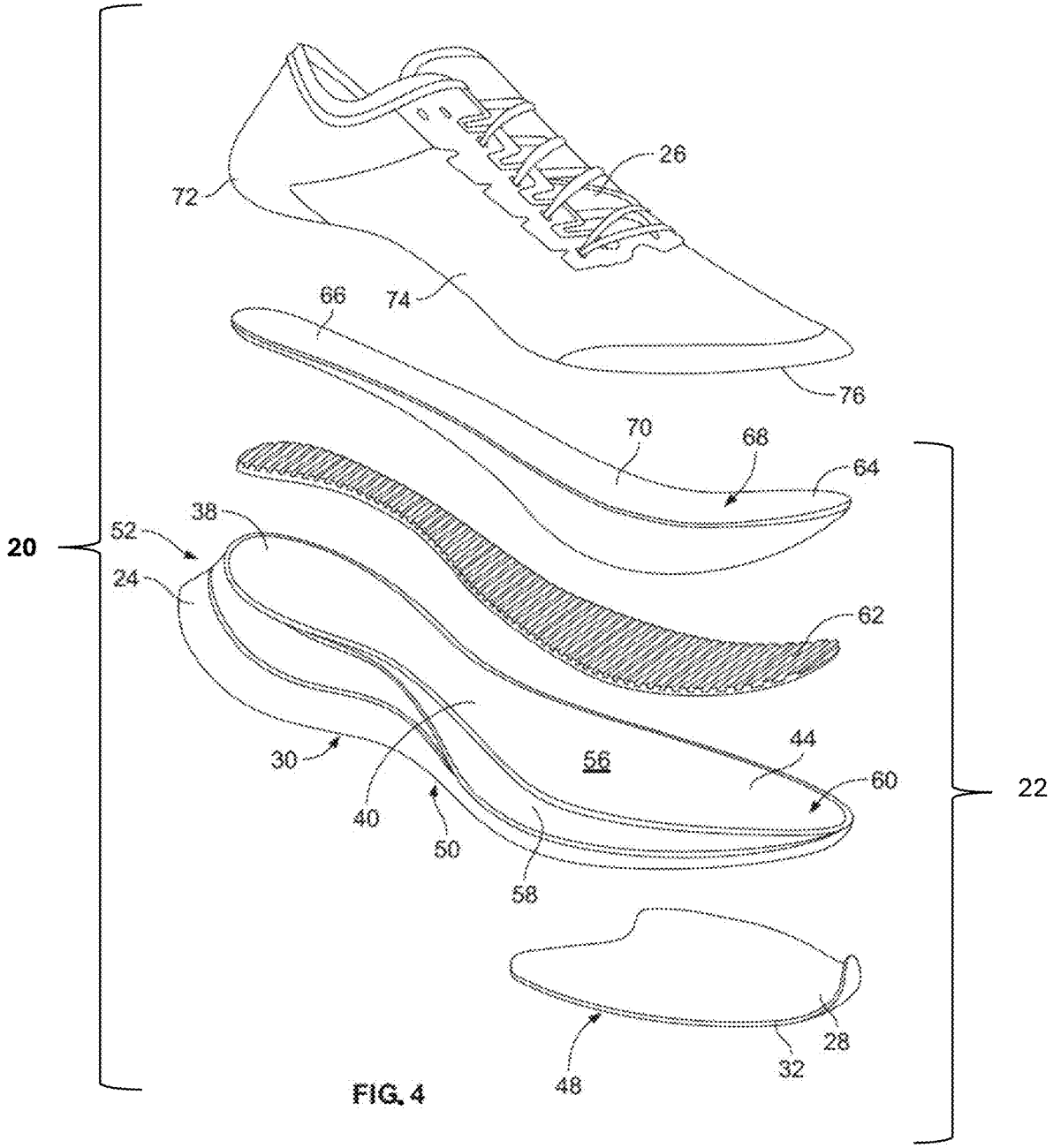
FIG. 4 is an exploded perspective view of the footwear of FIG. 1.
Figure 6:
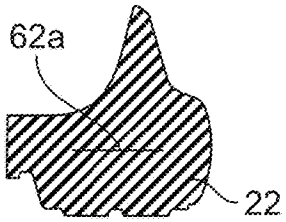
FIG. 6 is a fragmentary cross-section view taken substantially along line 6-6 in FIG. 5A in the direction generally indicated.
Figure 7:
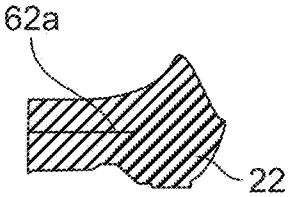
FIG. 7 is a fragmentary cross-section view taken substantially along line 7-7 in FIG. 5A in the direction generally indicated.
Figure 8:
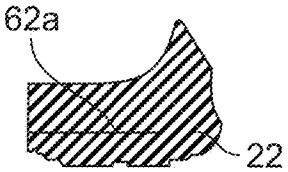
FIG. 8 is a fragmentary cross-section view taken substantially along line 8-8 in FIG. 5A in the direction generally indicated.
Figure 9:
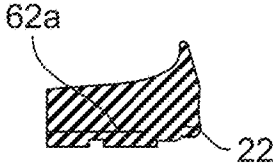
FIG. 9 is a fragmentary cross-section view taken substantially along line 9-9 in FIG. 5A in the direction generally indicated.

The forefoot area 44 of the sole 22 includes a front support member 46 having an outsole portion 48 shown in FIG. 4 that forms a front contact area between the bottom surface 50 of the sole 22 and an underlying surface during movement. The front support member 46 cooperates with the lateral and medial support members 34 and 36 at the rear end 52 of the sole 22 to form a triangular support region with three contact areas or pressure areas 54*a*, 54*b* and 54*c* associated with the lateral support member, medial support member and the front support member. The three pressure areas 54*a*, 54*b* and 54*c* provide enhanced support, balance and stability to a users' feet during movement on generally even terrain or uneven terrain, by enabling at least two of the pressure areas to be in contact with an underlying support surface at a given time during movement. For example, during a heel strike, the lateral and medial support members 34 and 36 contact the underlying support surface, and on uneven terrain, at least the lateral support member 34 and the front support member 46 or the medial support member 36 and the front support member 46 will be in contact with the underlying support surface. In this way, the lateral and medial support member 34 and 36 and the front support member 46 combine to provide enhanced balance and stability to a user during movement over conventional footwear having an outsole with a generally flat or level bottom surface or tread with a low profile, that contacts an underlying support surface. As shown in FIG. 2, the front support member 46 is formed by a portion of the midsole 24 and a portion of the outsole 28 having one or more tread members 32. Preferably, the portion of the outsole 28 is made of rubber but may be made with any suitable material or combination of materials. The tread members 32 on the outsole portion 48 may have the same shape or different shapes.

Referring to FIGS. 4-9, the upper 26 is formed of a knit material that is attached to an upper surface 56 of the sole 22 by an adhesive, stitching or sewing or by any suitable attachment method. It should be appreciated that the upper 26 may be made with any suitable material or combination of materials. In the illustrated embodiment, the midsole 24 of the sole 22 has a peripheral wall 58 that forms a recessed area 60. The recessed area 60 is configured to receive a support plate 62 and a footbed 64. The footbed 64 has an angled portion 66 and a curved portion 68 and forms the bottom surface or inner surface of the upper 26. The footbed 64 may be attached to the upper 26 using an adhesive or by sewing the footbed to the upper. The upper surface 70 of the footbed 64 supports a user's foot when the user's foot is inserted in the upper 26. In the illustrated embodiment, the footbed 64 is preferably made of a foam material but may be made with any suitable material or combination of materials. As shown, the footbed extends from the heel area 72 to the forefoot area 74, and more specifically, the toe area 76 of the upper 26.

In this embodiment, the support plate 62 is a unitary component that extends from the heel area 38 to the forefoot area 44 of the sole 22 and has a rear convex portion 63 and a front concave portion 65 that supports a user's foot. In this embodiment, the support plate 62 is preferably made with a carbon fiber-based material but may be made with any suitable material or combination of materials. Also, the support plate 62 has a thickness of 1.0 to 2.0 mm, but may have any suitable thickness. In another embodiment, the support plate 62 has different thicknesses along the length of the support plate. It is also contemplated that the support plate 62 may be positioned in the heel area 38, the midfoot area 40 or the forefoot area 44 of the sole 22, or extend between two or more of these areas. In another embodiment, the support plate 62 is molded or embedded in the sole 22.

Figure 5A:
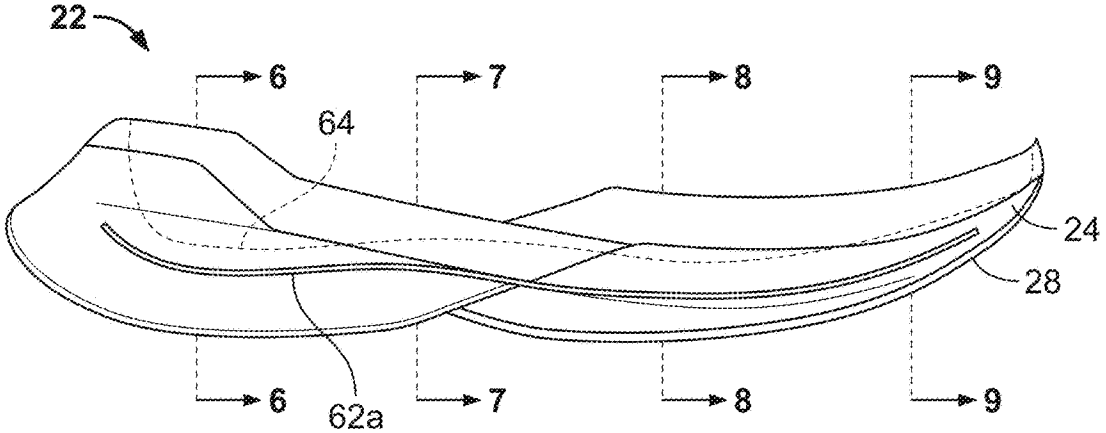
FIG. 5A is a side view of the footwear of FIG. 4 showing the support plate.
Figure 5B:
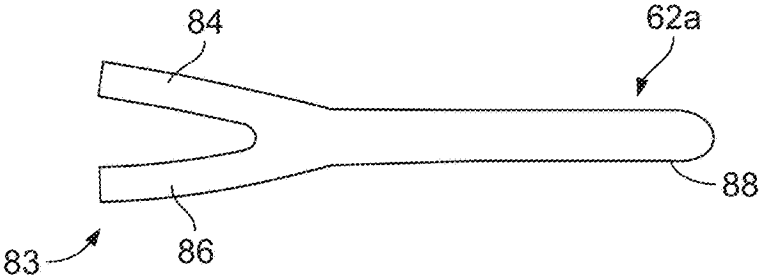
FIG. 5B is a top view of the support plate of FIG. 4.
Figure 5C:
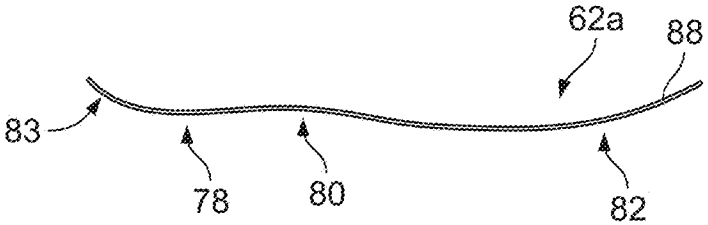
FIG. 5C is a side view of the support plate of FIG. 5B.

Referring to FIGS. 5A, 5B and 5C, another embodiment is shown and includes a support plate 62*a* that extends from the heel area 38 to the forefoot area 44 of the sole 22 and corresponds to the same areas of the upper 26. The support plate 62*a* is preferably made with a metal or a carbon-fiber based material, but may be made with any suitable material or combination of materials. In the illustrated embodiment, the support plate 62 has a rear concave portion 78, a middle convex portion 80 and a front concave portion 82. Another embodiment of the support plate 62*a* is shown in FIG. 5B, where the rear part 83 of the support plate 62*a* having the rear concave portion 78, has a Y-shape formed by a first arm 84 and a second arm 86 that are spaced from each other. The ends of the first arm 84 and the second arm 86 meet or join together at an end of front part 88 of the support plate 62*a*. In the illustrated embodiment, the front part 88 of the support plate 62*a* extends from the midfoot area 40 to the forefoot area 44 of the sole 22. It should be appreciated that the support plate 62*a*, i.e., the rear part 83 and the front part 88, may have any suitable shape and/or may be any suitable size or length.

In this embodiment, the support plate 62 has a width that is less than a width of the upper surface 56 of the sole 22. In this way, the support plate 62 provides support along the central area or middle area of a user's foot. It is contemplated that the support plate 62 may have a width that is equal to the width of the upper surface 56 of the sole 22 or have different widths along the length of the support plate. For example, FIG. 5B shows that the support plate 62 has different widths along the length of the support plate. In another embodiment, two or more support plates are positioned on the sole 22 to support a users' feet where the support plates may be positioned adjacent to each other or spaced from each other.

Figure 10:
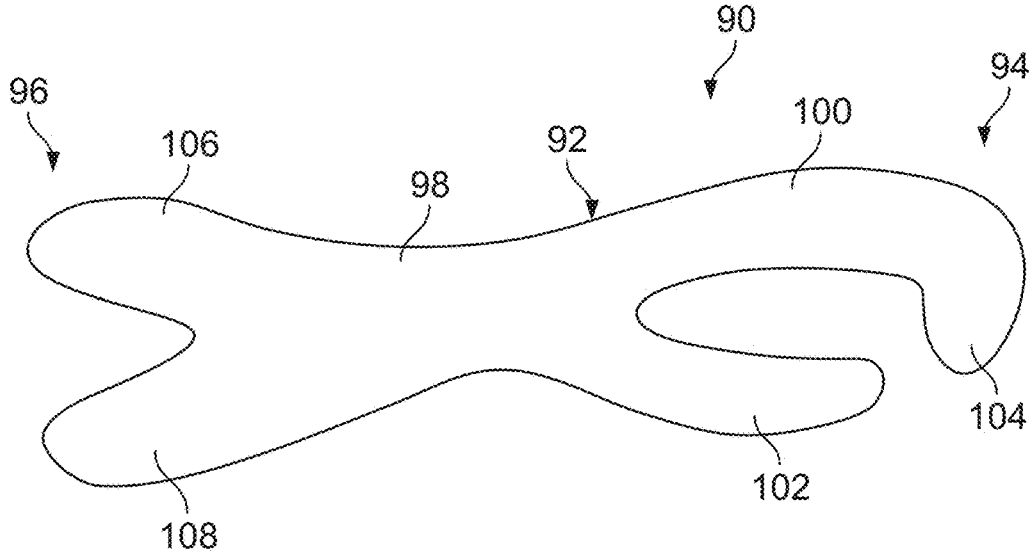
FIG. 10 is another embodiment of the support plate shown in FIG. 5A.

Referring now to FIG. 10, another embodiment of the support plate is illustrated and generally indicated as 90, and includes a body 92 having a front end 94, a rear end 96 and a middle portion 98 extending between the front end and the rear end. The front end 94 of the support plate 90 has a front lateral arm 100 and a front medial arm 102 that each extend from the middle portion 98 toward a front end of a sole. The front lateral arm 100 extends along a lateral side of a forefoot area of the sole and has a toe portion 104 that extends transversely from the front lateral arm 100 in a toe area of the sole. The front medial arm 102 extends along a medial side of the forefoot area of the sole and has a length that is less than a length of the front lateral arm 100. As shown in the illustrated embodiment, the middle portion 98 has a width that is less than a width of the front end 94 and the rear end 96 of the support plate 90. It should be appreciated that the middle portion 98 may have a width that is the same as the width of the front end 94 and/or the rear end 96 of the support plate. As shown, the rear end 96 of the support plate 90 includes a rear lateral arm 106 and a rear medial arm 108 that each extend at an angle relative to the middle portion 98 of the support plate 90. The rear lateral arm 106 extends toward the lateral side of the heel area of the sole and the rear medial arm 108 extends toward the medial side of the heel area.

Figure 11:
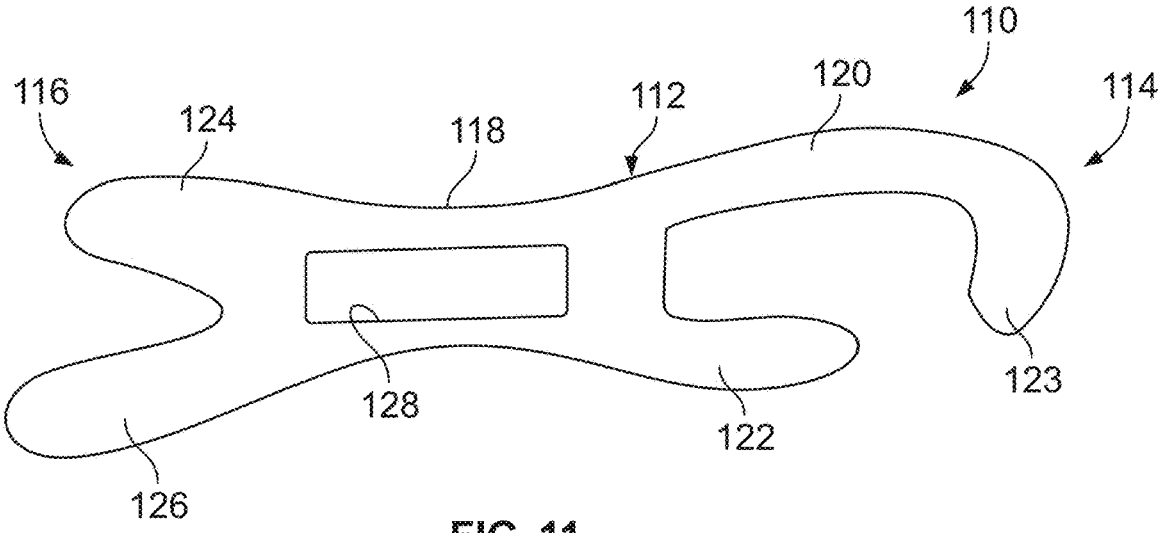
FIG. 11 is a further embodiment of the support plate shown in FIG. 5A.

Referring now to FIG. 11, a further embodiment of the support plate is illustrated and generally indicated as 110, and includes a body 112 having a front end 114, a rear end 116 and a middle portion 118 extending between the front end and the rear end. The front end 114 of the support plate 110 has a front lateral arm 120 and a front medial arm 122 that each extend from the middle portion 118 toward a front end of a sole. The front lateral arm 120 extends along a lateral side of a forefoot area of the sole and has a toe portion 123 that extends transversely from the front lateral arm in a toe area of the sole. The front medial arm 122 extends along a medial side of the forefoot area of the sole and has a length that is less than a length of the front lateral arm 120. As shown in the illustrated embodiment, the middle portion 118 has a width that is less than a width of the front end 114 and the rear end 116 of the support plate 110. It should be appreciated that the middle portion 118 may have a width that is the same as the width of the front end 114 and/or the rear end 116 of the support plate. The rear end 116 of the support plate 110 includes a rear lateral arm 124 and a rear medial arm 126 that each extend at an angle relative to the middle portion 118 of the support plate 110. As shown in FIG. 11, the rear medial arm 126 has a length that is greater than a length of the rear lateral arm 124. It should be appreciated that the length of the rear lateral arm 124 may be greater than the length of the rear medial arm 126 or that the lengths of the rear lateral arm and the rear medial arm are the same. In this embodiment, the support plate 110 also includes a rectangular-shaped through-hole 128 in a midfoot area of the support plate. The through-hole 128 decreases the weight of the support plate 110 while enhancing the flexibility of the support plate in the midfoot area of the sole. It should be appreciated that the through-hole 128 may be square-shaped, circular, oval-shaped or may have any suitable shape. It should also be appreciated that the support plate 110 may include a plurality of through-holes formed in the support plate to enhance flexibility while reducing the overall weight of the support plate.

Figure 12:
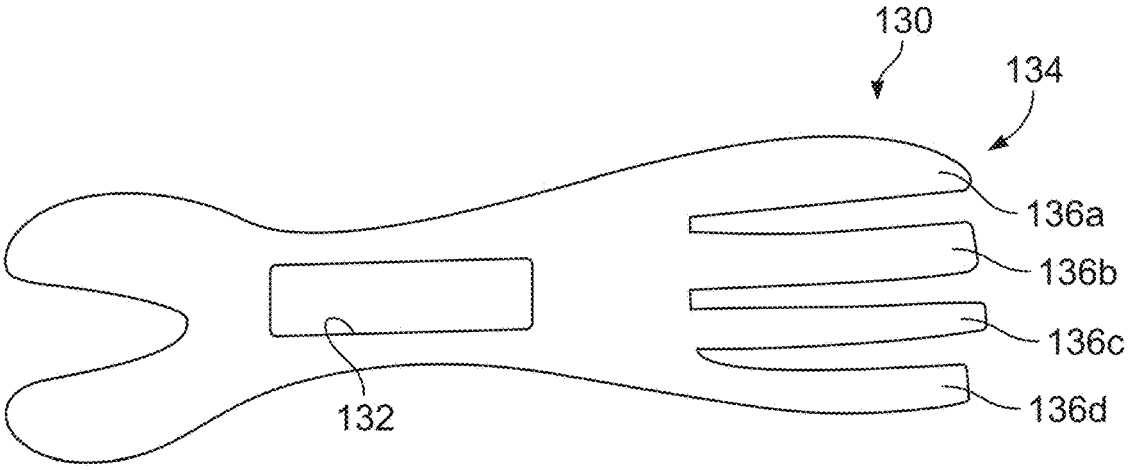
FIG. 12 is another embodiment of the support plate shown in FIG. 5A.

FIG. 12 illustrates another embodiment of the support plate generally indicated as 130, where the support plate 130 is similar to the support plate 90 shown in FIG. 10 except that the support plate 130 includes a through-hole 132 formed in a midfoot area of the support plate and a front end 134 includes a plurality of finger members 136*a*, 136*b*, 136*c* and 136*d*. It should be appreciated that the through-hole 132 may have any suitable shape and the support plate 130 may have a plurality of through-holes as described above. In the illustrated embodiment, the front end 134 of the support plate includes four finger members 136*a*, 136*b*, 136*c* and 136*d* that each extend longitudinally toward a front end of a sole. It should be appreciated that the finger members 136*a*, 136*b*, 136*c* and 136*d* may be any suitable size or shape. In this embodiment, the finger members 136*a*, 136*b*, 136*c* and 136*d* each have a length that is the same. In another embodiment, one, two, three or all of the finger members have a length that is different from a length of the other finger members. It should be further appreciated that the front end of the support plate may have two or more finger members.

While particular embodiments of the present sole are shown and described, it will be appreciated by those skilled in the art that changes and modifications may be made thereto without departing from the invention in its broader aspects and as set forth in the following claims.

What is claimed is:

1. An article of footwear comprising:

a sole including midsole and an outsole attached to said midsole, said sole having a longitudinal axis and a lateral support member, a medial support member and a front support member that are independent from each other and combine to form a triangular contact region on a bottom surface of the sole;

said lateral support member having a front end, a rear end and a central portion between said front end and said rear end, said central portion having a width that is greater than a width of said front end and a width of said rear end, said lateral support member including a lateral portion of said midsole and a lateral portion of said outsole, wherein said lateral portion of said midsole completely surrounds a perimeter of said lateral portion of said outsole; and said medial support member having a front end, a rear end and a central portion between said front end and said rear end, said central portion having a width that is greater than a width of said front end and a width of said rear end, said medial support member including a medial portion of said midsole and a medial portion of said outsole, wherein said medial portion of said midsole completely surrounds a perimeter of said medial portion of said outsole, wherein said lateral support member and said medial support member are entirely spaced apart from each other across the longitudinal axis of the sole.

2. The article of footwear of claim 1, wherein a longitudinal axis of the lateral support member and a longitudinal axis of the medial support member are each at an angle relative to the longitudinal axis of the sole.

3. The article of footwear of claim 1, wherein the sole includes a channel that is formed between the lateral support member and the medial support member.

4. The article of footwear of claim 3, wherein said channel extends from a heel area of the sole to at least partially in a midfoot area of the sole.

5. The article of footwear of claim 1, further comprising a support plate positioned on the sole.

6. The article of footwear of claim 5, wherein said support plate has a rear convex portion and a front concave portion.

7. The article of footwear of claim 5, wherein said support plate has a rear concave portion, a middle convex portion and a front concave portion.

8. The article of footwear of claim 5, wherein said sole includes a recessed area and said support plate is seated in said recessed area.

9. The article of footwear of claim 5, wherein said support plate is embedded in said sole.

10. The article of footwear of claim 5, wherein said support member includes a rear part and a front part, and wherein said rear part includes a first arm and second arm that are spaced from each other.

11. The article of footwear of claim 5, wherein said support plate is made of a carbon fiber-based material.

12. The article of footwear of claim 1, wherein said lateral support member and said medial support member each have an oblong shape.

13. The article of footwear of claim 1, wherein said lateral portion of said outsole and said medial portion of said outsole each include at least one tread member.

14. The article of footwear of claim 1, wherein said midsole includes a bottommost surface and said lateral portion of said outsole of said lateral support member and said medial portion of said outsole of said medial support member each include a bottom surface, and wherein said bottom surface of said lateral portion of said outsole and said bottom surface of said medial portion of said outsole are each at a distance from a bottom surface of said upper that is greater than a distance of said bottommost surface of said midsole from said bottom surface of said upper.

15. A sole for an article of footwear, the sole comprising:

a midsole including a longitudinal axis and a lateral support member, a medial support member and a front support member that are independent from each other and combine to form a triangular contact region including the lateral support member, the medial support member and the front support member on a bottom surface of the midsole; and an outsole attached to said midsole;

said lateral support member and said medial support member each having an oblong shape and being entirely spaced apart from each other across the longitudinal axis of the midsole, said lateral support member and said medial support member each including a portion of said midsole and a portion of said outsole, wherein said portion of said midsole completely surrounds a perimeter of said portion of said outsole;

a rear end of said midsole having an indentation between said lateral support member and said medial support member.

16. The sole of claim 15, wherein a longitudinal axis of the lateral support member and a longitudinal axis of the medial support member are each at an angle relative to the longitudinal axis of the midsole.

17. The sole of claim 15, further comprising a support plate positioned on the midsole.

18. The sole of claim 15, wherein said portion of said outsole on said lateral support member and said portion of said outsole on said medial support member each include at least one tread member.

* * * * *